US008690279B2

(12) United States Patent
Zhang et al.

(10) Patent No.: US 8,690,279 B2
(45) Date of Patent: Apr. 8, 2014

(54) LIQUID EJECTING APPARATUS AND CONTROL METHOD THEREOF

(75) Inventors: Junhua Zhang, Shiojiri (JP); Toshihisa Saruta, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 564 days.

(21) Appl. No.: 13/005,449

(22) Filed: Jan. 12, 2011

(65) Prior Publication Data

US 2011/0221809 A1 Sep. 15, 2011

(30) Foreign Application Priority Data

Mar. 11, 2010 (JP) ..... 2010-055024

(51) Int. Cl.
*B41J 29/38* (2006.01)
*B41J 2/165* (2006.01)

(52) U.S. Cl.
USPC ..... 347/10; 347/11; 347/35

(58) Field of Classification Search
USPC ..... 347/10
See application file for complete search history.

(56) References Cited

U.S. PATENT DOCUMENTS

| | | | |
|---|---|---|---|
| 6,561,622 B1 | 5/2003 | Suzuki et al. | |
| 8,096,632 B2 | 1/2012 | Ihara | |
| 2006/0221106 A1 | 10/2006 | Mataki | |
| 2007/0176952 A1 | 8/2007 | Sekiguchi | |
| 2009/0079773 A1 | 3/2009 | Hosono et al. | |
| 2009/0295854 A1 | 12/2009 | Kawakami et al. | |

FOREIGN PATENT DOCUMENTS

| | | | |
|---|---|---|---|
| CN | 101121317 | 2/2008 | |
| JP | 61-146556 | 7/1986 | |
| JP | 07-266580 | 10/1995 | |
| JP | 2000-233518 | 8/2000 | |
| JP | 2006-306076 | 11/2006 | |
| JP | 2009-073074 | 4/2009 | |
| JP | 2009073074 | * 4/2009 | ..... B41J 2/18 |
| JP | 2009-286074 | 12/2009 | |

* cited by examiner

*Primary Examiner* — Uyen Chau N Le
*Assistant Examiner* — Kajli Prince
(74) *Attorney, Agent, or Firm* — Workman Nydegger

(57) ABSTRACT

A resonance pulse is a voltage waveform substantially containing an expansion element for varying a voltage to expand a pressure chamber, an expansion sustaining element generated following with the expansion element, and sustaining a maximum voltage at a predetermined value, and a contraction element generated following with the expansion sustaining element, and varying the voltage to contract the pressure chamber. A time span from a front end of the expansion element to a front end of the contraction element is set as ½ of an inherent vibration cycle of ink in the pressure chamber.

5 Claims, 6 Drawing Sheets

FIG. 6

| | FIRST FL PERIOD | THIRD FL PERIOD | SECOND FL PERIOD |
|---|---|---|---|
| DRIVING PULSE | RESONANCE PULSE (FLP1) | INTERMEDIATE PULSE (FLP2) | RECORDING DRIVING PULSE (DP) |
| NUMBER OF SHOTS | 100 SHOTS | 100 SHOTS | DETERMINED NUMBER |
| Th | Tc/2 | 3 Tc/4 | DETERMINED NUMBER |
| Vd | Vd1 | 0.8 Vd1 | DETERMINED NUMBER |

LIQUID EJECTING APPARATUS AND CONTROL METHOD THEREOF

CROSS REFERENCES TO RELATED APPLICATIONS

The entire disclosure of Japanese Patent Application No. 2010-55024, filed Mar. 11, 2010 is expressly incorporated herein by reference.

BACKGROUND

1. Technical Field

The present invention relates to a liquid ejecting apparatus and a method of controlling the same.

2. Related Art

According to an ink jet printer, which is one example of a liquid ejecting apparatus, in a state where a power source is turned off, or in a standby state where recording is not performed when the power source is turned on, the nozzle surface of a recording head is sealed (capped) by a capping member. Therefore, evaporation from the nozzles of the solvent from the ink is suppressed. However, since the nozzle surface is released from the capping state during printing operations (during recording operation), the meniscus of the nozzle is exposed to the atmosphere. For this reason, during a period in which the nozzle surface is opened from the capping member, since the solvent of ink gradually evaporates from the nozzle with the passage of time, the viscosity of ink in the vicinity of the nozzle is increased. In addition, when capped, even though the nozzle forming surface of the recording head is sealed by the capping member or the like, a space is formed between the capping member and the nozzle surface. As the meniscus of ink is exposed to the air remaining in the space, it is hard to completely suppress the solvent of ink from naturally evaporating. If the increased viscosity of ink becomes significant, a problem (ejection fault) is likely to happen, for example, the weight or flight velocity of ink to be ejected is decreased, or the ink is not ejected. Since, in a short period of time, the viscosity of the ink in the vicinity of the meniscus is changed so that ink is difficult to be fluctuated using a pressure generating element, a problem is likely to happen, for example, the above-described ejection fault occurs or the flying direction of ink is curved so that its landing position is deviated from.

In order to prevent the ejection fault of ink as described above, various maintenance processes are executed. For example, the pressure generating element is driven to vary the pressure in a pressure chamber, so that liquid droplets are idle-ejected (hereinafter referred to as flushing) from the nozzles to forcibly remove ink with increased viscosity or bubbles contained in ink. In order to more reliably discharge ink with increased viscosity or the bubbles existing in an ink passage (liquid passage) together with ink from the nozzles by the flushing, it is necessary to apply as high as possible a pressure fluctuation to ink or bubbles. Accordingly, for example, as disclosed in JP-A-2009-73074, a printer which can produce a driving pulse for the flushing (the maintenance) has been proposed, in which the pressure variation applied to the inside of the pressure chamber by the pressure generating element is sympathetically with the natural characteristic of the liquid generated in the pressure chamber to make the pressure fluctuation applied to the inside of the pressure chamber large.

However, in the case of using the driving pulse for the flushing, as the pressure fluctuation of ink in the pressure chamber is increased, residual vibration resulting from the same is also increased. For this reason, in the state where the meniscus in the nozzle is disordered and thus the meniscus is unstable, if a next driving pulse is applied to the pressure generating element, the flying of ink ejected from the nozzle is curved, so that the flown ink is not likely to land at a predetermined position. In the case where the flushing operation is transited to the recording operation in a state where the meniscus is unstable, the ejection fault likely occurs at the time of a recording operation to cause the image quality, such as a recording image, to deteriorate. In addition, there is a problem in that, after ink, of which the viscosity increase is particularly advanced, in the vicinity of the meniscus at the time of flushing is ejected, when the driving pulse for the flushing is repeatedly applied to the pressure generating element and thus is continuously used, it is difficult to suppress the amount of ink to be consumed.

SUMMARY

An advantage of some aspects of the invention is that there is provided a liquid ejecting apparatus including a liquid ejecting head which ejects a liquid filled in a pressure chamber from nozzle openings by causing pressure fluctuation in the pressure chamber through operation of a pressure generating member; and a driving signal generating member which drives the pressure generating member to generate a driving signal having a first driving pulse which is not applied outside of flushing and is applied inside of flushing, and a second driving pulse which is applied even outside of the flushing, wherein the first driving pulse includes a first voltage variation element which varies a voltage to expand the pressure chamber, a voltage sustaining element which is produced following with the first voltage variation element and sustains the voltage in a constant value, and a second voltage variation element which is produced following with the voltage sustaining element and varies the voltage to compress the pressure chamber, and wherein according to pressure vibration which is caused by applying the first voltage variation element to the pressure generating member, the second voltage variation element is applied to the pressure generating member in a state where the meniscus of a nozzle opening is moved from the pressure chamber to an injection side.

In this instance, the word "flushing" means that a liquid, of which its viscosity is increased as a solvent of the liquid is evaporated, is ejected from a nozzle, so that the viscosity of the liquid is near a state before the viscosity of the liquid increased (ideally, the state at the time of manufacturing the liquid), and the ejection ability of the liquid, that is, the amount or flight velocity of the liquid to be ejected, is near an ideal state in view of design and specification.

BRIEF DESCRIPTION OF THE DRAWINGS

The invention will be described with reference to the accompanying drawings, wherein like numbers reference like elements.

FIG. 6 is a table illustrating a driving pulse used for flushing according to another embodiment of the invention.

DESCRIPTION OF EXEMPLARY EMBODIMENTS

Below, the preferred embodiments to carry out the invention will be described with reference to the accompanying drawings. In this instance, the embodiment described below is variously limited as a preferable specific example of the invention, but the scope of the invention is not limited to an aspect other than that specifically described to limit the invention. In addition, in the embodiments, an ink jet type recording apparatus (hereinafter referred to as a printer) as one example of a liquid ejecting apparatus will be described by giving an example of an ink jet type recording head (hereinafter referred to as a recording head) as one example of a liquid ejecting head.

Figure 1:
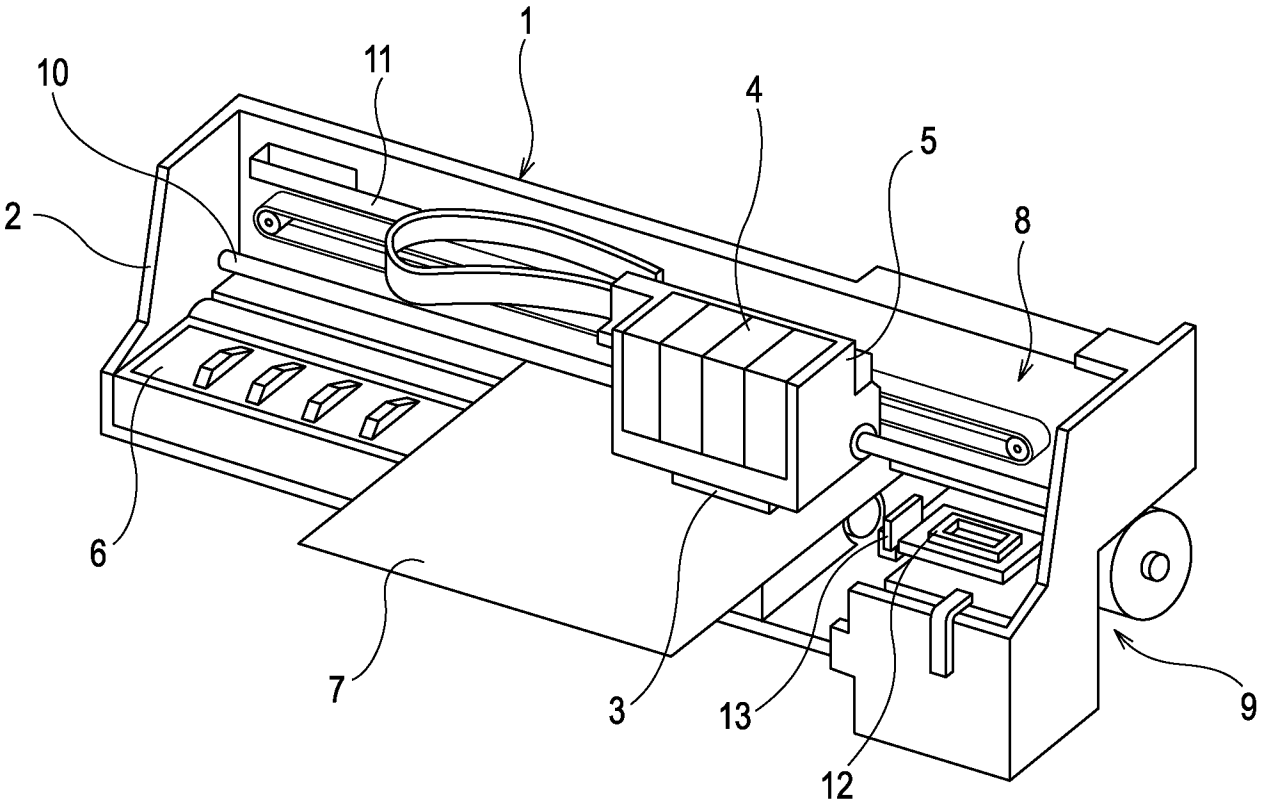
FIG. 1 is a plan view illustrating a configuration of a printer according to the invention.
Figure 2:
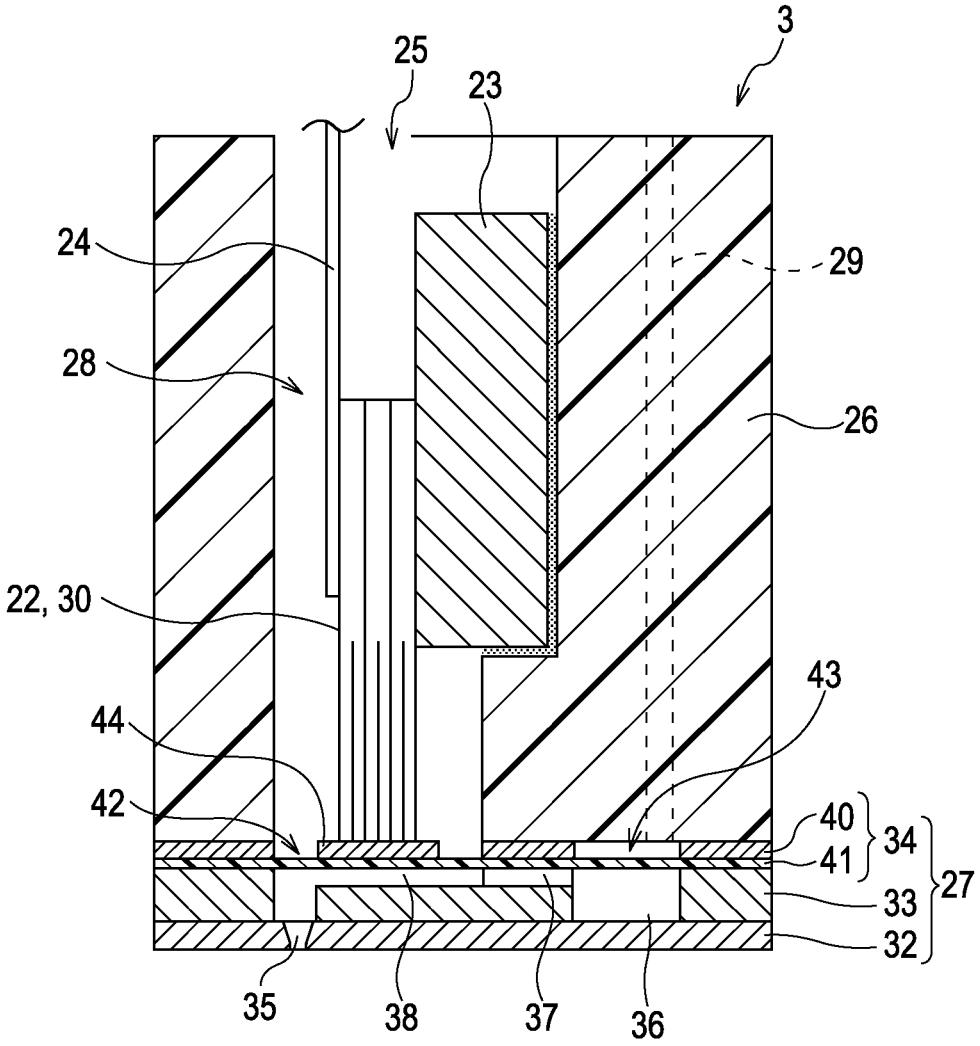
FIG. 2 is a cross-sectional view illustrating a main part of a recording head according to the invention.

FIG. 1 is a perspective view illustrating the configuration of a printer 1, and FIG. 2 is a cross-sectional view illustrating a main part of a recording head 3. The printer 1 includes, in a housing 2, a carriage 5 to which the recording head 3, one kind of a liquid ejecting head, is attached, and an ink cartridge 4 storing ink (corresponding to a liquid in the invention) is detachably attached, a platen 6 provided below the recording head 3, a carriage movement mechanism 8 which reciprocates the carriage 5 (the recording head 3) in the paper width direction of a recording paper 7 (corresponding to an ejected object in the invention), that is, a main scanning direction, and a paper transfer mechanism 9 which transports the recording paper 7 in a sub scanning direction perpendicular to the main scanning direction. In this instance, a configuration in which the ink cartridge 4 is mounted at the housing 2 of the printer 1 to supply the liquid to the recording head 3 via an ink supply tube may be employed.

The carriage 5 is attached to be pivotally supported by the guide rod 10 installed in the main scanning direction, and is configured to move along the guide rod 10 in the main scanning direction by operation of the carriage movement mechanism 8. The position of the carriage 5 in the main scanning direction is detected by a linear encoder 11, and its detection signal, that is, an encoder pulse, is transmitted to a control unit 56 (refer to FIG. 3) of a printer controller. As a result, the control unit 56 controls a recording operation (ejection operation) which is performed by the recording head 3 while recognizing the scanning position of the carriage 5 (recording head 3) on the basis of the encoder pulse from the linear encoder 11.

A home position serving as a scanning origin is set at an end region of an outer side (the right side in FIG. 1) rather than a recording region in the movement range of the carriage 5. In this embodiment, a capping member 12 (corresponding to a region except for the ejected object in the invention) sealing a nozzle forming surface (a nozzle plate 32: refer to FIG. 2) of the recording head 3, and a wiper member 13 for cleaning the nozzle forming surface are placed at the home position. And, the printer 1 is configured to record characters or images on the recording paper 7 in both directions of forward movement of the carriage 5 (the recording head 3) moving toward the opposite end from the home position, and backward movement of the carriage 5 returning to the home position side from the opposite end, that is, to perform so-called bi-direction recording. In this instance, the capping member 12 is a tray-shaped member with an opened upper surface, and is made of an elastic member of rubber, elastomer or the like. A liquid absorbing member (not illustrated) made of a liquid absorbing material, such as felt, sponge or the like, to absorb ink is provided in the capping member. The capping member 12 configured as described above performs idle ejection (expelling) of ink droplets (one kind of ink), so that it is used as an ink receiving portion to receive ink droplets during flushing which will be described later to eliminate (remove) ink with increased viscosity or bubbles remaining in ink.

In this embodiment, the recording head 3 includes, as shown in FIG. 2, a vibrator unit 25 unitized by a piezoelectric vibrator group 22, a fixing plate 23, and a flexible cable 24, a head case 26 which can receive the vibrator unit 25 therein, and a passage unit 27 forming a series of ink passages extending from a reservoir (common ink chamber) 36 to a nozzle opening 35 (corresponding to nozzles of the invention) through a pressure chamber (a pressure generating chamber) 38.

First, the vibrator unit 25 will be described. The piezoelectric vibrator 30 (one kind of pressure generating member in the invention) consisting of the piezoelectric vibrator group 22 is formed in an elongated comb-tooth shape extending in the longitudinal direction, and is split in extremely narrow widths as much as tens of μm. The piezoelectric vibrator 30 is constituted of piezoelectric vibrators of a vertical vibrating type which are flexible in the longitudinal direction. Each of the piezoelectric vibrators 30 is fixed as a so-called cantilever state of which the stationary end portion is joined on the fixing plate 23 and the free end portion protrudes outwardly from the front end edge of the fixing plate 23. In each of the piezoelectric vibrators 30, the front end of the free end portion is joined to an island portion 44 constituting a diaphragm portion 42 in each of the passage units 27 which will be described later. The flexible cable 24 is electrically connected to the piezoelectric vibrators 30 at a lateral surface of the stationary end portion which is opposite to the fixing plate 23. In addition, the fixing plate 23 supporting each of the piezoelectric vibrators 30 is made of a metallic plate having rigidity enough to receive a reaction force from the piezoelectric vibrator 30. In this embodiment, the fixing plate is made from a stainless steel plate of about 1 mm in thickness.

The head case 26 is a member of a hollow box shape which is made of an epoxy-based resin, for example, and fixes the passage unit 27 at its front end surface (lower surface). The head case receiving the vibrator unit 25, which is one kind of actuator, in a receiving cavity portion 28 formed in the case. In addition, a case passage 29 is formed in the head case 26 to penetrate the head case in the height direction. The case passage 29 is a passage to supply ink to the reservoir 36 from the ink cartridge 4.

Next, the passage unit 27 will be described. The passage unit 27 includes a nozzle plate 32, a passage forming substrate 33, and a vibration plate 34, in which the nozzle plate 32 is placed on one surface of the passage forming substrate 33, while the vibration plate 34 is placed on the other surface of the passage forming substrate 33 which is opposite to the nozzle plate 32, thereby layering and integrating the nozzle plate and the vibration plate through adhesion or the like.

The nozzle plate 32 is a thin plate of stainless steel, on which a plurality of nozzle openings 35 are provided in a row pattern at a pitch corresponding to dot formation density. In this embodiment, for example, 180 nozzle openings 35 are provided in a row, so that a nozzle row is formed by the nozzle openings 35. Four rows of the nozzle arrays are provided in parallel.

The passage forming substrate 33 is a sheet-like member consisting of the reservoir 36, an ink supply hole 37, and a pressure chamber 38 which form a series of ink passages. More specifically, the passage forming substrate 33 is a sheet-like member provided with a plurality of cavity portions, which serve as the pressure chambers 38 each corresponding to the nozzle opening 35, defined by partitions, and provided with cavity portions serving as the ink supply hole 37 and the reservoir 36. And, the passage forming substrate 33 according to this embodiment is made by etching a silicon wafer. The pressure chamber 38 is formed as an elongated chamber extending in a direction perpendicular to the row installation direction (a direction of nozzle array) of the nozzle openings 35. The ink supply hole 37 is formed as a narrow portion having a narrow passage and communicating between the pressure chamber 38 and the reservoir 36. In addition, the reservoir 36 is a chamber for supplying ink stored in the ink cartridge 4 to each of the pressure chambers 38, and communicates with each of the corresponding pressure chambers 38 through the ink supply hole 37.

The vibration plate 34 is a composite plate of double structure which is made by laminating a resin film 41, such as PPS (Polyphenylene Sulfide), on a metallic support plate 40 of, for example, stainless steel. In addition, the vibration plate is a member having a diaphragm portion 42 for varying the volume of the pressure chamber 38 by sealing one opening surface of the pressure chamber 38, and provided with a compliance portion 43 for sealing the one opening surface of the reservoir 36. The diaphragm portion 42 is provided with the island portion 44 for joining the front end of the free end portion of the piezoelectric vibrator 30, in which the island portion is formed by etching a portion of the support plate 40 corresponding to the pressure chamber 38 to remove the corresponding portion in an annular shape. The island portion 44 is formed in the shape of an elongated block extending in a direction perpendicular to the row installation direction of the nozzle openings 35, similar to the plane shape of the pressure chamber 38. The resin film 41 in the vicinity of the island portion 44 serves as an elastic film. In addition, the portion serving as the compliance portion 43, that is, the portion corresponding to the reservoir 36, is made of the only resin film 41, since the support plate 40 is removed by an etching process after the manner of the opening shape of the reservoir 36.

Since the front end surface of the piezoelectric vibrator 30 is joined to the island portion 44, the volume of the pressure chamber 38 can be fluctuated by flexing the free end portion of the piezoelectric vibrator 30. The fluctuation in volume causes an accompanying pressure fluctuation in ink stored in the pressure chamber 38. The recording head 3 is configured to eject ink droplets from the nozzle openings 35 by utilizing the pressure fluctuation.

Next, the electrical configuration of the printer 1 will be described.

Figure 3:
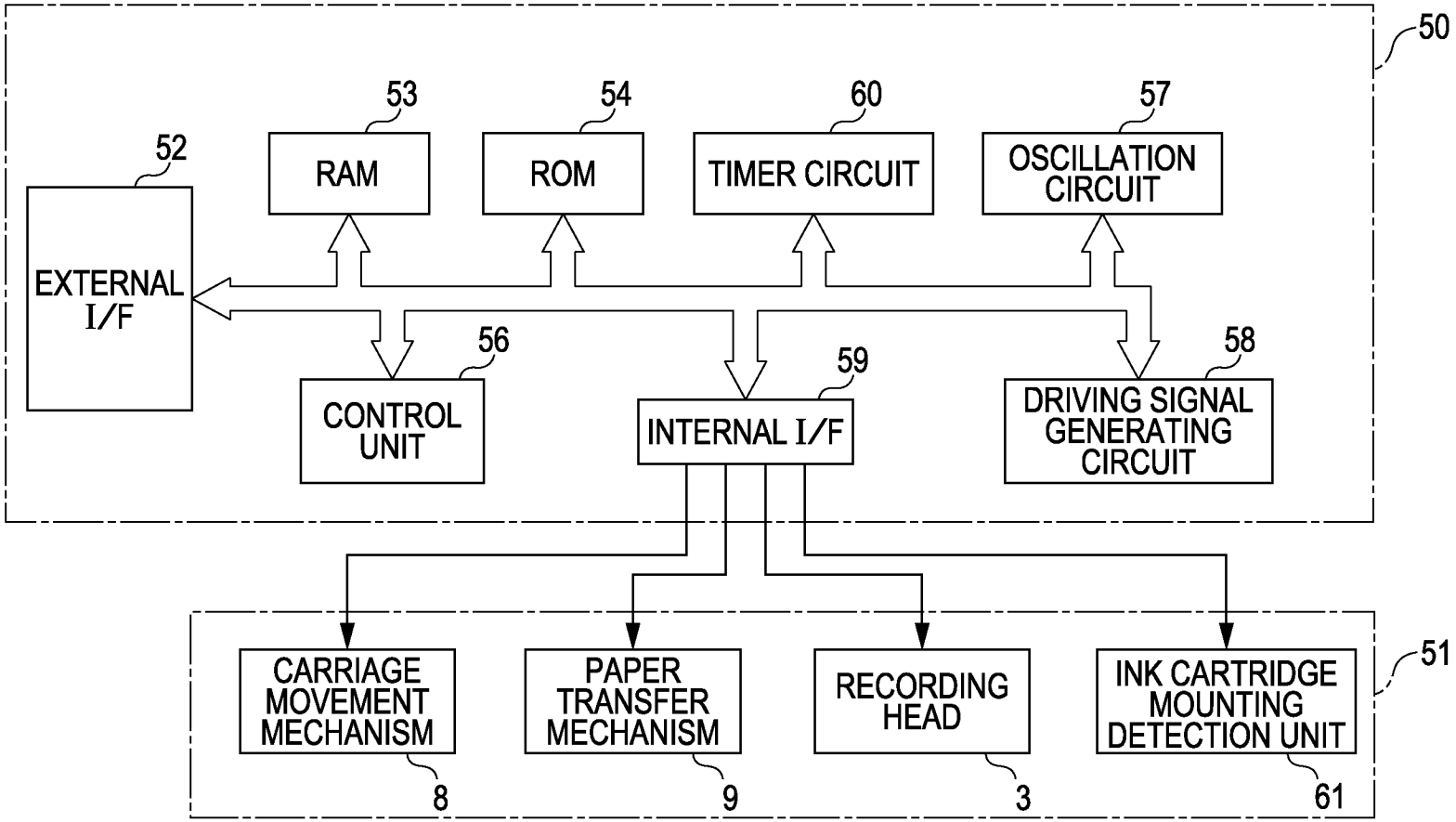
FIG. 3 is a block diagram illustrating an electrical configuration of a printer according to the invention.

FIG. 3 is a block diagram illustrating the electrical configuration of the printer 1. The printer 1 according to this embodiment is generally configured by a printer controller 50 and a print engine 51. The print controller 50 includes an external interface (external I/F) 52 for receiving print data or the like from an external device such as a host computer, a RAM 53 for storing various data, a ROM 54 for storing a control program for diverse controls or the like, a control unit 56 for performing the overall control of the respective units according to the control program stored in the ROM 54, a oscillation circuit 57 for generating a clock signal, a driving signal generating circuit 58 (corresponding to a driving signal generating unit) for generating a driving signal COM which is supplied to the recording head 3, an internal interface (internal I/F) 59 for outputting dot pattern data, which is obtained by building up the print data for each dot, the driving signal, and so forth, to the recording head 3, and a timer circuit 60 serving as a time measuring unit to perform a time measuring operation. In addition, the print engine 51 includes the recording head 3, the carriage movement mechanism 8, the paper transferring mechanism 9, and an ink cartridge mounting detection unit 61 for detecting the mounting of the ink cartridge 4 to the carriage 5. The ink cartridge mounting detection unit 61 detects the ink cartridge 4 mounted at first time to output a detection signal to the control unit 56. The control unit 56 executes an initial charging process of charging the ink passage of the record head 3 with ink of the ink cartridge 4 on the basis of the detection signal. In addition, the timer circuit 60 performs time measurement of the mounting time of the ink cartridge 4 from a point at which ink is initially changed, and time measurement of the elapsed time from the final recording process (printing process) to a next recording process, that is, the time left unused (stop time) at which continuous ejection of ink is not performed. In this instance, the ink cartridge mounting detection unit 61 may be an electrical detection unit, a mechanism detection unit, or the like which can detect the mounting of the ink cartridge 4.

The above-described control unit 56 controls the ejection of the ink droplets by the recording head 3, and each of other parts of the printer 1, according to the operation program stored in the ROM 54. The control unit 56 converts the print data, which is input from the external device via the external I/F 52, into ejection data used for the ejection of the ink droplets in the recording head 3. The converted ejection data is transmitted to the recording head 3 via the internal I/F 59, and the supply of the driving signal COM to the piezoelectric vibrator 30 is controlled on the basis of the ejection data to perform the ejection of the ink droplets, that is, the recording operation (ejection operation) in the recording head 3. In addition, the control unit 56 executes the flushing described later on the basis of the elapsed time measured by the timer circuit 60.

The driving signal generating circuit 58 includes one driving pulse for recording (corresponding to the first driving pulse in the invention) to eject ink towards the recording paper 7 from the nozzle openings 35 by driving the piezoelectric vibrator 30 in a period (one ejection period or one recording period) T of one pixel, and generates the driving signal COM1 in repeating units. In addition, the driving signal generating circuit 58 generates a driving signal COM2 including a driving pulse FLP for flushing used in the flushing described later on the basis of the elapsed time measured by the timer circuit 60. The driving signal generating circuit 58 supplies the driving signals COM1 and COM2 to the recording head 3 side via the internal I/F 59, respectively.

Herein, the increased viscosity of the ink in the ink passage of the recording head 3 will be described. In the printer 1, there is a case where as the meniscus (free surface) exposed from the nozzle openings 35 is exposed to the air with the lapse of time to evaporate the solvent of ink, the viscosity of ink increases, that is, the viscosity of ink becomes higher than that of ink at the fabricating time. If the viscosity of ink is increased, ejection fault, such as a so-called dead pixel, in which ink is not ejected from the nozzle opening 35, or curved flight, may occur. For this reason, the printer 1 moves the recording head 3 to an ink receiving position, which is called as a flushing point, located on the capping member 12 of the home position or the platen at a predetermined interval after the recording process (printing process), in which the ink is ejected onto the recording paper 7 by using the driving pulse for the recording to perform the printing such as text or images, or during the recording process, and then performs the flushing as an ejection ability recovery process in a state where the recording head is opposite to the ink receiving portion. In the flushing, ink with an increased viscosity or bubbles contained in ink is forcibly removed by repeatedly applying the driving pulse FLP for the flushing to the piezoelectric vibrator 30.

The driving pulse for the recording is generated by the driving signal generating circuit 58 when a common printing mode to perform the printing, such as text or image, onto the recording paper 7 is set, and, for example, substantially includes an expansion element which increases (changes) a potential in a predetermined gradient to expand (extend) the pressure chamber 38, an expansion sustaining element which sustains a distal potential of the expansion element during a predetermined time, and a contraction element which contracts (compresses) the pressure chamber 38 by lowering (changing) the potential in a predetermined gradient. In addition, the driving pulse for the recording is set so that a time span from the front end of the expansion element to the front end of the contraction element is set as a value other than ½ of inherent vibration cycle Tc of ink in the pressure chamber 38. The piezoelectric vibrator 30 is driven by applying the respective elements of the driving pulse for the recording to the piezoelectric vibrator 30, and thus ink is ejected from the nozzle 35. In this instance, the driving pulse for the recording according to the invention may include other elements. For example, a configuration, in which a vibration damping element for damping residual vibration is laid after the contraction element, may be employed.

Figure 4:
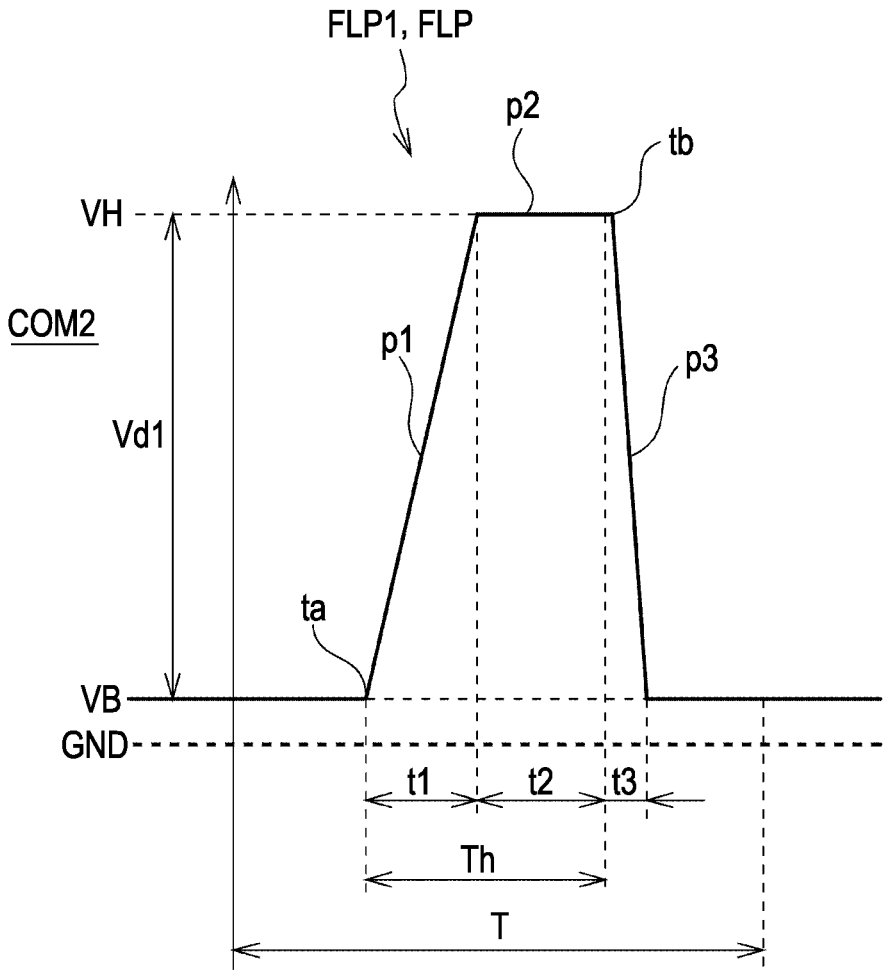
FIG. 4 is a waveform diagram illustrating a configuration of a resonance pulse according to the invention.

FIG. 4 is waveform diagram illustrating the configuration of the resonance pulse FLP1 included in the driving signal COM2 which is generated by the driving signal generating circuit 58. In this instance, in FIG. 4, the vertical axis means the potential of the resonance pulse FLP1, and the horizontal axis means the time (μs).

The printer 1 according to the first embodiment is configured in such a way that the driving signal generating circuit 58 generates the driving signal COM2 including one resonance pulse FLP1 (corresponding to the first driving pulse in the invention), which is one kind of the driving pulse FLP for the flushing used in the flushing, in one ejection cycle T. The resonance pulse FLP1 is a driving pulse set in such a way that the time span from the front end of the expansion element to the front end of the contraction element is different from that of the driving pulse for recording. The resonance pulse is a driving pulse to drive the piezoelectric vibrator 30 for the purpose of the flushing, thereby ejecting ink towards regions other than the recording paper 7 from the nozzle opening 35, that is, the capping member 12 in the state where the nozzle forming surface is sealed in this embodiment. In this embodiment, in the flushing using the driving signal COM2 including the resonance pulse FLP1 of the invention, the ejection from one shot to a predetermined shot (e.g., 10 shots) by applying the driving signal COM2 of a predetermined frequency (e.g., several kHZ) in one ejection cycle T is set as a flushing unit seg (flushing segment). During the flushing, since the driving signal COM2 is repeatedly applied (supplied) to the piezoelectric vibrator 30 by the predetermined number of flushing segments (e.g., several tens to several thousands of segments in total), the ink in the ink passage is discharged from the nozzle opening 35.

The resonance pulse FLP1 is a trapezoidal pulse signal, as shown in FIG. 4, and is set in such a way that a potential difference (a driving voltage (the difference between the maximum voltage and the reference voltage)) between the maximum (expansion) potential VH and the reference potential VB is vdl. The resonance pulse FLP1 contains an expansion element p1 (corresponding to the first voltage variation element in the invention) for abruptly expanding (extending) the pressure chamber 38 by increasing (varying) the potential in a relatively steep predetermined gradient from the reference potential VB to the maximum potential VH during the time span t1, an expansion sustaining element p2 (corresponding to the voltage sustaining element in the invention) for sustaining the maximum potential VH, which is the distal potential of the expansion element p1, during the predetermined time (time span t2 (t2>t1)), and a contraction element p3 (corresponding to the second voltage variation element in the invention) for abruptly contracting (compressing) the pressure chamber 38 by lowering (varying) the potential in relatively steep predetermined gradient from the expansion potential VH to the reference potential VB during the time span t3 (t3<t1, t2).

In the invention, the resonance pulse FLP1 is characterized in that the time span (t1+t2, and indicated by reference numeral Th in FIG. 4) from the front end (indicated by reference numeral to in FIG. 4) of the expansion element p1 to the front end (indicated by reference numeral tb in FIG. 4) of the contraction element p3 is set as ½ of the inherent vibration cycle Tc of ink in the pressure chamber 38. That is, the resonance pulse is set so that the contraction element p3 is applied to the piezoelectric vibrator 30 in the state where the meniscus in the nozzle opening 35 moves from the pressure chamber 38 side to the ejection side according to the pressure fluctuation generated by applying the expansion element p1 to the piezoelectric vibrator 30.

In this instance, the inherent vibration cycle Tc is a value determined by the shape of the nozzle opening 35 or the pressure chamber 38 or the like, and the vibration cycle Tc of ink in the pressure chamber 38 can be expressed by Equation (1) below:

$$Tc=2\pi\sqrt{[(Mn\times Ms)/(Mn+Ms)\times Cc]} \quad (1)$$

wherein, in Equation (1), Mn means the inertance in the nozzle opening 35, Ms means the inertance in the ink supply hole 37 communicating with the pressure chamber 38, and Cc means the compliance (indicating the variation in volume per unit pressure, and the degree of flexibility) of the pressure chamber 38. In Equation (1), the inertance M means the movement ease of ink in the ink passage, and is a mass of ink per unit cross area. Supposing that the density of ink is ρ, the cross section of a plane perpendicular to a flow direction of ink in the passage is S, and the length of the passage is L, the inertance M can be approximately expressed by Equation (2) below:

$$\text{Inertance } M=(\text{density } \rho\times\text{length } L)/\text{cross section } S \quad (2)$$

wherein, Tc is not limited to Equation (2), and may be the vibration cycle of the pressure chamber 38.

Next, the flushing of the configuration using the resonance pulse FLP1 will be described. When the common print mode to perform printing, such as text or images, onto the recording paper 7 is converted to the flushing mode to perform the flushing, the printer 1 according to the invention moves the recording head 3 to the home position side, so that the nozzle forming surface of the recording head 3 is opposite to the upper surface opening side of the capping member 12. In the printer 1 according to the invention, if the timing to perform the flushing comes, in which while the process of recoding the image or the like onto the recording medium, such as the recording paper 7 or the like, is performed, the recording process is interrupted for a predetermined interval and the flushing is performed, the controller 56 converts the mode to the flushing mode so as to generate the resonance pulse FLP1 (driving pulse FLP for the flushing) from the driving signal generating circuit 58. In the flushing mode, the controller repeatedly applies the driving pulse FLP for the flushing to the piezoelectric vibrator 30 in the state where the recording head 3 is opposite to the capping member 12, as described above, so that the ink is ejected onto the capping member 12 from the nozzle openings 35.

In the flushing, if the resonance pulse FLP1 is supplied to the piezoelectric vibrator 30, it is operated as follows. First, if the expansion element p1 is applied to the piezoelectric vibrator 30, the piezoelectric vibrator 30 is contracted in the longitudinal direction of the element, and thus the pressure chamber 38 is abruptly expanded from the reference volume corresponding to the reference voltage VB to the maximum volume corresponding to the maximum voltage VH (expansion process (corresponding to the first variation process in the invention)). With the expansion process, the meniscus of the ink in the nozzle opening 35 is largely introduced in the pressure chamber 38 side, and simultaneously, ink is supplied to the pressure chamber 38 from the reservoir 36 side via the ink supply hole 37. In the expansion process, the expanding state of the pressure chamber 38 is constantly sustained over the supply period t2 of the expansion sustaining element p2 (expansion sustaining process).

After the expansion sustaining element p2, if the contraction element p3 is applied to the piezoelectric vibrator 30, the piezoelectric vibrator 30 is stretched, and thus the pressure chamber 38 is abruptly contracted from the maximum volume to the reference volume corresponding to the reference potential VB (contraction process (corresponding to the second variation process in the invention)). Ink is pressed in the pressure chamber 38 by the abrupt contraction of the pressure chamber 38, and thus several p1 to tens of pl of is ejected from the nozzle openings 35 towards the capping member 12.

In the above-described flushing, since the resonance pulse FLP1 of the invention is set in such a way that the time span Th from the front end to of the expansion element p1 to the front end tb of the contraction element p3 is ½ of the inherent vibration cycle Tc of ink in the pressure chamber 38, the contraction element p3 is applied to the piezoelectric vibrator 30 in the state where the meniscus moves from the pressure chamber 38 side to the outside of the nozzle opening 35, that is, the ejection side, according to the pressure fluctuation of the vibration cycle Tc generated in ink within the pressure chamber 38 side by applying the expansion element p1 to the piezoelectric vibrator 30. Therefore, since the reaction of the meniscus introduced into the pressure chamber 38 which tends to return to its original position can be resonated (synthesized) with the pressure fluctuation by the contraction element p3, the ejection pressure of ink is increased, so that ink which is hard to fluctuate due to increased viscosity, or bubbles contained in ink can be easily ejected from the nozzle openings 35. As a result, it is possible to effectively recover the ejection ability of the recording head 3 which is deteriorated due to the increase in the viscosity of ink. In addition, since the ejection ability can be recovered in a short time, it is possible to shorten the time required for the flushing. In addition, since the printer according to the invention has higher discharge effectiveness of ink with increased viscosity than that of the related art in the flushing, it is possible to further lengthen the time left unused.

The invention is not limited to the above-described embodiment, and can be variously modified based on the description of the claims.

Second Embodiment

Next, the second embodiment will be described. The second embodiment will be described based on the configuration different to the first embodiment, and unless otherwise mentioned, the configuration of the printer or its control method is regarded as the same.

Figure 5:
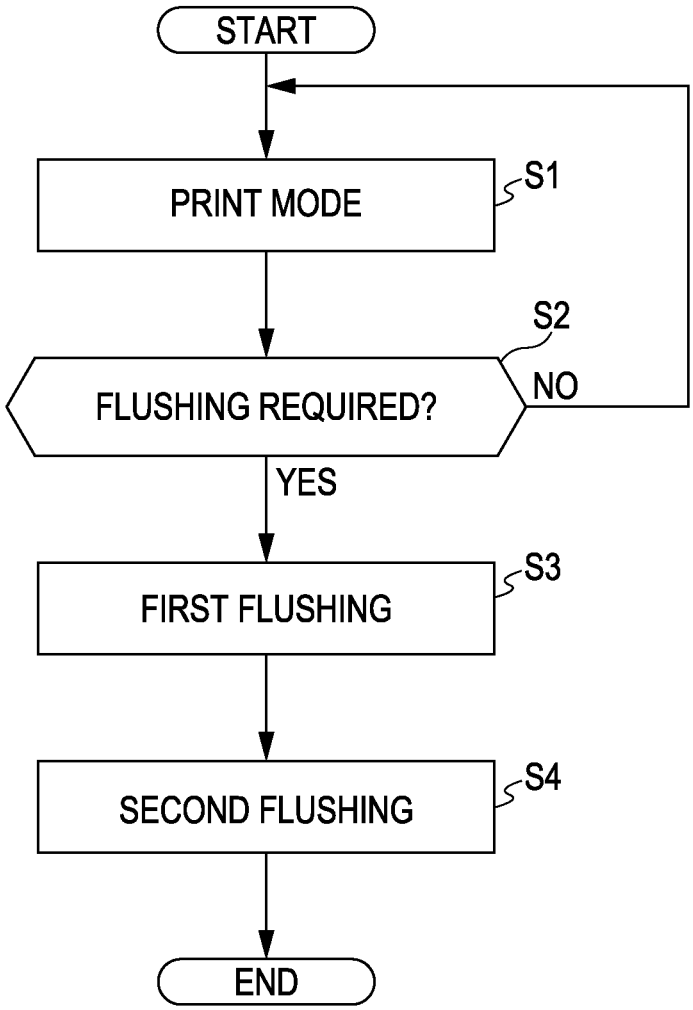
FIG. 5 is a flowchart illustrating a process of flushing according to another embodiment of the invention.

FIG. 5 is a flowchart illustrating a flow of the flushing according to the second embodiment.

As compared with the driving pulse for the recording, when the resonance pulse FLP1 of the second embodiment drives the piezoelectric vibrator 30, the printer 1 according to the invention is set in such a way that the ejection amount of ink ejected from the nozzle opening 35 is large and the flight velocity of ink increases. In addition, a configuration may be employed, in which if the common print mode is converted into the flushing mode, the resonance pulse FLP1 is applied to the piezoelectric vibrator 30 to perform the first flushing process, and then the driving pulse for the recording is applied to the piezoelectric vibrator 30 to perform the second flushing process. That is, the flushing may include a first flushing period in which the first flushing is performed by applying the resonance pulse FLP1 of predetermined shots (e.g., 100 shots) to the piezoelectric vibrator 30, and a second flushing period in which the second flushing is performed by applying the driving pulse for the recording to the piezoelectric vibrator 30 after the first flushing period.

More specifically, in a case where it is determined that the flushing is necessary (S2: YES) while the process of recording the image or the like onto the recording medium such as recording paper 7 is performed (print mode) (S1), the print mode is converted into the flushing mode, and then the resonance pulse FLP1 is repeatedly applied to the piezoelectric vibrator 30, thereby performing the first flushing (S3). Then, after the first flushing is performed, the second flushing is performed by repeatedly applying the driving pulse for the recording to the piezoelectric vibrator 30 (S4). At that time, in a case where it is determined that the flushing is not necessary (S2: NO), the print mode is continuously set.

With the above-described configuration, after the ink with increased viscosity in the vicinity of the meniscus is ejected by the first flushing, the flushing is performed by applying the driving pulse for the recording, which is used for the common ejection with respect to the recording paper 7, to the piezoelectric vibrator 30. Consequently, in the initial step of the flushing, ink can be ejected by the higher pressure fluctuation to more effectively eject ink with increased viscosity. In the late step of the flushing, the stability of the meniscus can be secured by suppressing the pressure fluctuation at the ejection from being lower than the initial step. As a result, while the effect of recovering the ejection ability is increased, it is possible to quickly perform the recording process with respect to the recording paper 7 by making vibrations of the meniscus converge as fast as possible. In addition, as compared with the case where the flushing is performed by using only the resonance pulse FLP1, it is possible to reduce the consumption of ink. In this instance, as compared with the driving pulse for the recording, the resonance pulse FLP1 may be set in such a way that as the driving voltage Vd is increased, so that the amount of ink ejected from the nozzle opening 35 increases and the flight velocity of ink gets faster, when the piezoelectric vibrator 30 is driven. As compared with the driving pulse for the recording, the resonance pulse FLP1 may be set in such a way that the voltage varying rate of the expansion element p1 gets higher. As compared with the driving pulse for the recording, the resonance pulse FLP1 may be set in such a way that the voltage varying rate of the contraction element p3 increased.

In addition, in the second embodiment, the control unit 56 may control the timing to convert the first flushing into the second flushing according to the time left unused of ink which is measured by the timer circuit 60. That is, the control unit 56 according to the invention serves as a conversion control unit. More specifically, as the time left unused measured by the timer circuit 60 lengthens, the timing to convert the first flushing into the second flushing may become slower. Meanwhile, as the time left unused measured by the timer circuit 60 is shorter, the timing to convert the first flushing into the second flushing may become faster. Consequently, the recovery of the ejection ability and the suppression of the amount of ink to be consumed can be compatible. That is, since the possibility of the viscosity of ink increasing increases as the time without ejecting ink lengthens, ink with increased viscosity can be reliably discharged by performing the first flushing for longer. On the other hand, since the possibility of the viscosity of ink lowering increases as the time without ejecting ink shortens, it proceeds to the second flushing at a fast step by shortening the time to perform the first flushing, thereby suppressing consumption of ink. Accordingly, it is possible to perform just enough flushing according to the viscosity of ink.

Third Embodiment

Next, the third embodiment will be described. The third embodiment will be described based on the configuration different to the first embodiment, and unless otherwise mentioned, the configuration of the printer or its control method is regarded as the same.

FIG. 6 is a table illustrating a driving pulse used for the flushing according to the third embodiment.

In addition, the printer 1 according to the third embodiment may employ a configuration in which the driving signal COM generated from the driving signal generating circuit 58 includes an intermediate pulse FLP2 (e.g., Th=3Tc/4, Vd=0.8Vd1) which is set in such a way that the ejection amount and the flight velocity of ink ejected from the nozzle opening 35 are a value between the driving pulse for the recording and the resonance pulse FLP1 when the piezoelectric vibrator 30 is driven, and the intermediate pulse FLP2 is applied to the piezoelectric vibrator 30 to perform the third flushing process after the first flushing and before the second flushing. That is, the flushing process includes the third flushing period in which the intermediate pulse FLP2 of predetermined shots (e.g., 100 shots) is applied to the piezoelectric vibrator 30 to perform the third flushing between the first flushing period to perform the first flushing process and the second flushing period to perform the second flushing process.

In addition, each of the above-described embodiments is preferable in cases where ink (high-viscosity liquid) having viscosity higher than that of existing ink, of which the viscosity is from 10 millipascals to 30 millipascals, for example, photo-curable ink which is cured by irradiation of light energy such as ultraviolet rays, is ejected, or the viscosity of ink naturally increases. In this instance, ink is more difficult to fluctuate by pressure fluctuation than ink of low viscosity such as an existing ejected aqueous ink. Therefore, in a case where the flushing is performed with respect to high-viscosity ink, application of pressure fluctuation higher than low-viscosity ink such as existing aqueous ink is required. However, if the flushing is performed by using the resonance pulse FLP1, since the reaction resulting from the pressure chamber 38, which is expanded by the expansion element p1 and then is contracted, can be resonated (synthesized) with the pressure fluctuation of the contraction element p3, the ejection pressure of the liquid is increased, so that it is easy to eject ink with increased viscosity from the nozzle opening 35.

In addition, each of the above-described embodiments, the resonance pulse FLP shown in FIG. 4 is illustrated as one example of the resonance pulse FLP in the invention, the shape of the pulse is not limited to the illustration. If the time span Th from the front end to of the expansion element p1 to the front end tb of the contraction element p3 is set as ½ of the inherent vibration cycle Tc of ink in the pressure chamber 38, any waveform can be used. In addition, the number of flushing can be set as an arbitrary.

Furthermore, in each of the above-described embodiments, the piezoelectric vibrator 30 of so-called vertical vibration mode is illustrated as one example of the pressure generating element, but it is not limited thereto. For example, the invention can be applied to a case of a piezoelectric vibrator of so-called bending vibration mode or a heater element. In this instance, in the case of employing the piezoelectric vibrator of bending vibration mode, the waveform of the resonance pulse FLP shown in FIG. 4 is reversed vertically.

The invention is not limited to a printer, as long as it is a liquid ejecting apparatus capable of controlling ejection by using a plurality of driving signals, and may be applied to a variety of ink jet type recording apparatuses, such as plotters, facsimile machines, copy machines, and the like, and liquid ejecting apparatuses other than recording apparatuses such as display manufacturing apparatuses, electrode manufacturing apparatuses, chip manufacturing apparatuses, and the like.

What is claimed is:

1. A liquid ejecting apparatus comprising:

a liquid ejecting head which ejects a liquid filled in a pressure chamber from nozzle openings by causing pressure fluctuation in the pressure chamber through operation of a pressure generating member; and a driving signal generating member which drives the pressure generating member to generate a driving signal having a first driving pulse which is not applied outside of flushing and is applied inside of flushing, and a second driving pulse which is applied even outside of the flushing, wherein the first driving pulse includes a first voltage variation element which varies a voltage to expand the pressure chamber, a voltage sustaining element which is produced following with the first voltage variation element and sustains the voltage in a constant value, and a second voltage variation element which is produced following with the voltage sustaining element and varies the voltage to compress the pressure chamber, and wherein according to pressure vibration which is caused by applying the first voltage variation element to the pressure generating member, the second voltage variation element is applied to the pressure generating member in a state where a meniscus of a nozzle opening is moved from the pressure chamber to an injection side.

2. The liquid ejecting apparatus according to claim 1, wherein any one of the plurality of driving modes to drive the pressure generating member is converted to a predetermined driving mode, the first driving pulse is set so that an ejection amount of the liquid ejected from the nozzle is increased and a flight velocity of the liquid increases when the pressure generating member is driven, as compared with the second driving pulse, and when the driving mode is set as a flushing mode to perform flushing, the driving signal generating member applies the first driving pulse to the pressure generating member to perform the first flushing process, and applies the second driving pulse to the pressure generating member to perform the second flushing process.

3. The liquid ejecting apparatus according to claim 2, further comprising a time measuring unit which measure a time when the liquid ejecting head continuously does not eject the liquid, and a conversion control unit which controls a timing to convert the first flushing process to the second flushing process according to the time measured by the time measuring member.

4. The liquid ejecting apparatus according to claim 3, wherein the conversion control member slows the timing to convert the first flushing process to the second flushing process as the time measured by the time measuring member is long, and speeds up the timing to convert the first flushing process to the second flushing process as the time measured by the time measuring member is short.

5. The liquid ejecting apparatus according to claim 2, wherein the driving signal generated by the driving signal generating member includes a third driving pulse which is set so that an ejection amount and flight velocity of the liquid ejected from the nozzle is a value between the first driving pulse and the second driving pulse when the pressure generating member is driven, and after the first flushing process and before the second flushing process, the third driving pulse is applied to the pressure generating member to perform the third flushing process.

* * * * *